United States Patent [19]

Segletes

[11] Patent Number: 4,513,666

[45] Date of Patent: Apr. 30, 1985

[54] CONFINEMENT FABRICATION TECHNIQUE FOR ASYMMETRICALLY CONFINED SHAPED-CHARGE WARHEADS

[75] Inventor: Steven B. Segletes, Pittsburgh, Pa.

[73] Assignee: The United States of America as represented by the Secretary of the Army, Washington, D.C.

[21] Appl. No.: 553,208

[22] Filed: Nov. 18, 1983

[51] Int. Cl.[3] ..... F42B 13/10

[52] U.S. Cl. ..... 102/476; 102/307

[58] Field of Search ..... 102/475, 476, 306–310, 102/492, 494, 495

[56] References Cited

U.S. PATENT DOCUMENTS 3,021,784 2/1962 Meddick ..... 102/306 X 3,732,818 5/1973 Thomanek ..... 102/306

4,374,495 2/1983 Thomanek ..... 102/472

*Primary Examiner*—Harold J. Tudor

*Attorney, Agent, or Firm*—Anthony T. Lane; Robert P. Gibson; Edward F. Costigan

[57] ABSTRACT

A plurality of disks with the outer shape of a circle has another circle punched non-concentrically in the disk. By stacking the proper assortment of disks about a symmetric warhead, the appropriate asymmetry profile can be obtained. Any asymmetry profile can be created through the proper stacking of disks even if the desired profile is non-linear. With an assortment of extra disks the confinement about a warhead can be quickly modified to provide another configuration based on the results of the test made on the previous warhead.

5 Claims, 6 Drawing Figures

CONFINEMENT FABRICATION TECHNIQUE FOR ASYMMETRICALLY CONFINED SHAPED-CHARGE WARHEADS

GOVERNMENT RIGHTS

The invention described herein may be manufactured and/or used by or for the Government for governmental purposes without the payment of any royalty thereon.

BACKGROUND OF THE INVENTION

High explosive anti-tank (HEAT) weapons have been in the American arsenal since World War II. The penetration mechanism within the HEAT warhead is the shaped-charge. A shaped-charge consists of a thin-walled metallic liner with high explosive molded around the outside of it. When the warhead strikes the target, the explosive is detonated. A shock front passes over the liner causing the liner to collapse upon itself. Under the extreme pressures of the explosion, the metallic liner behaves much like a fluid. When opposing sides of the coverging liner meet during collapse, a portion of the metal liner is "squirted" forward with high velocity (approx. 9 km/sec). This material is called the jet, and constitutes the penetrating element of the warhead.

The shaped charge is typically an axisymmetric warhead. That is to say, the phenomenon of asymmetric liner collapse is usually considered detrimental to warhead performance. This is however, not always the case. Applicant recently studied asymmetric liner collapse in hopes of producing a shaped-charge warhead with controllable jet deflection charcteristics using techniques of asymmetric warhead construction. In these experiments, the tests were carried out by first designing a warhead with asymmetric characteristics, building such a warhead, testing the warhead, and gathering data from the tests.

Warhead development can become a very slow process using traditional techniques. Two major drawbacks which were realized while fabricating asymmetric warhead bodies were fabrication time and cost. Both drawbacks result because of the fact that the asymmetric confinement bodies cannot be made on a lathe because of their asymmetric nature. Rather, a more time consuming process was required on a milling machine where the cost per confinement body was approximately $2000 (compared with $300 for a symmetric confinement). Once a final design exists, a machine can be modified to produce the asymmetric confinements cheaply en masse. However, experimental prototypes require individual attention and as such, are subject to present machinery limitations. During the developmental stages of the project where routine upgrading of the design occurs, refabrication of each new upgraded design becomes an expensive and time consuming proposition.

SUMMARY OF INVENTION

There is a need to provide a means for the study of asymmetric confinement effects upon the collapse of shape-charge liners and subsequent formation of a shaped-charge jet. In order to study the effects of asymmetric confinement upon shaped-charge jet formation, the confinement asymmetries will have to be introduced into the warhead in a totally controllable manner. In accordance with the present invention this is done by stacking disks upon each other to produce the desired asymmetry profile. Each disk has the outer shape of a circle with another circle punched non-concentrically in the disk. By stacking the proper assortment of disks about a symmetric warhead, the appropriate asymmetric profile can be obtained. Fabrication costs will decrease since the warhead body (before the disks are added) is symmetric and can be cheaply fabricated on a lathe. Also the disks themselves can be cheaply punched from a thin steel plate. Fabrication time will also decrease because of the simple machining required.

If the experimenter has an assortment of extra disks constructed, he can quickly modify the confinement about a warhead based on the results of the round just tested just by rearranging the disks on a new warhead. In this sense, the testing becomes very interactive and allows the experimenter to proceed at a rapid pace of testing. Any asymmetry profile can be created through the proper stacking of disks even if the desired profile is non-liner. The construction of non-linear asymmetry profiles is no more difficult when using this invention than simple linear or constant asymmetry profiles.

DETAILED DESCRIPTION OF PREFERRED EMBODIMENTS

Figure 1:
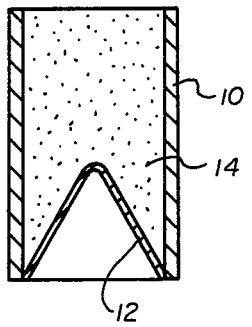
FIG. 1 is a sectional view of a symmetric warhead having a shaped charge liner.
Figure 2:
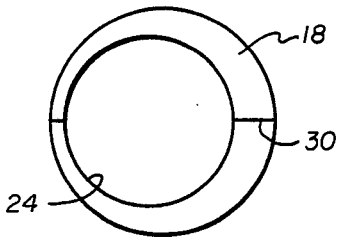
FIGS. 2, 3 and 4 are examples of circular disks with non-concentric circular holes punched in them.
Figure 3:
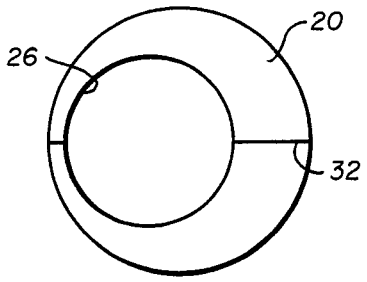
Figure 4:
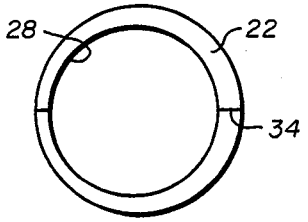

Reference is now made to FIG. 1 wherein is shown a cylindrical warhead 10 having a shaped charge liner 12 with high explosive 14 molded around it and within the warhead 10. When the warhead strikes the target the explosive is detonated. A shock front passes over the liner 12 causing it to collapse upon itself. The metallic liner 12 behaves much like a fluid under the extreme pressures of the explosion. When opposing sides of the converging liner meet during collapse, a portion of the metal liner squirts forward with high velocity. This material is called the jet and is the penetrating element of the warhead. The shaped charge is typically an axisymmetric warhead. However, shaped-charge warheads with controllable jet deflection characteristics are now being studied, using asymmetric warhead construction.

Figure 5:
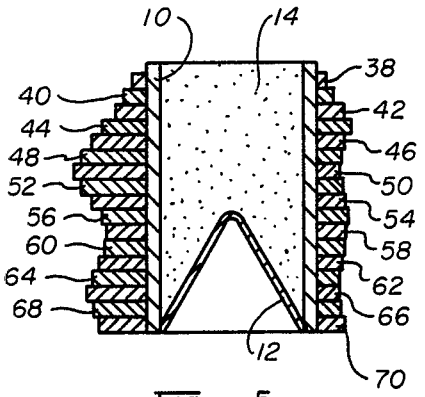
FIG. 5 is a sectional view of the symmetric warhead with the disks placed over it.

FIG. 5 is a sectional view of a symmetric warhead 10 converted into an asymmetric one by placing a plurality of disks 38–70 over it. As previously mentioned, both time and cost is saved in building an asymmetric warhead in this manner compared with contouring the warhead shape on a milling machine. A lathe is not practical because of its asymmetric nature.

Figure 6:
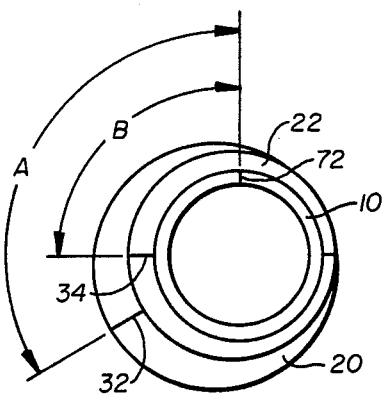
FIG. 6 shows how the disks' radial angle of placement can be indentified and controlled.

The experimenter stacks disks about the warhead taking into consideration both the degree of confinement asymmetry which is measured by the asymmetric thickness of the disk (between the circular hole and the outer edge of the disk), and the disks' radial angle of placement which is defined as the angle measured from some warhead reference to the axis of symmetry of the disk. FIG. 6 shows in plan view how two disks 20, 22 are positioned for the desired angle of placement. Here warhead 10 is shown in plan view, with a radial reference line 72 visibly made thereon. The axis of symmetry line 32 appears on disk 20 and line 34 appears on disk 22. Disk 20 is rotated until its symmetry axis line 32 reached the desired angle A from reference 72. Likewise, disk 22 may be rotated until its symmetry axis 34 is at angle B from reference 72.

This asymmetrically confined warhead, just described, can be used to study the effects of confinement asymmetries on shaped-charge jet formation. Should the experimenter wish to study various asymmetry profiles and their effects on shaped-charge jet formation, he need only obtain a symmetric test warhead and place a different assortment of disks about the warhead. The experimenter is not required to wait for each experimental confinement body to be machined seperately; rather a wide assortment of disks will satisfy his confinement fabrication needs.

By locating the axes of symmetry of various disks at incremental angles about the warhead, the shaped-charge penetrator can be made to spiral towards its target. By locating some axes at one radial angle about the warhead and other at a different radial angle, the warhead will produce two sequential shaped-charge jets which travel along distinct vector axes.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A shaped-charge warhead confinement fabrication consisting of a series of stacked disks having non-concentric holes therein, a symmetric shaped-charge warhead having a given outer diameter, said holes having a diameter matching said outer diameter of said warhead, said warhead passing through said disk holes, thereby providing an asymmetrically shaped warhead.

2. A shaped-charge warhead confinement fabrication as in claim 1 wherein said warhead as a shaped-charge liner therein, whereby said fabrication provides for asymmetrically collapsing shaped-charge liners.

3. A shaped-charge warhead confinement fabrication as in claim 1 wherein the confinement configuration may be made by changing the rotating said disks over said warhead.

4. A shaped-charge warhead confinement fabrication as in claim 1 wherein a shaped-charge jet penetrator is caused to spiral towards its target by locating the axes of symmetry of said disks at incremental angles about said warhead.

5. A shaped-charge warhead confinement fabrication as in claim 1 wherein two sequential shaped-charge jets are caused to travel along distinct vector axes by locating the axes of symmetry of some disks at one radial angle about said warhead and the axes of other disks at a different radial angle.

* * * * *